US010356530B2

(12) United States Patent
Hou

(10) Patent No.: US 10,356,530 B2
(45) Date of Patent: Jul. 16, 2019

(54) ELECTRONIC DEVICE AND LOUDSPEAKER THEREOF

(71) Applicant: SHANDONG GETTOP ACOUSTIC CO., LTD., Weifang, Shandong (CN)

(72) Inventor: Jie Hou, Shandong (CN)

(73) Assignee: SHANDONG GETTOP ACOUSTIC CO., LTD., Weifang, Shandong (CN)

( * ) Notice: Subject to any disclaimer, the term of this patent is extended or adjusted under 35 U.S.C. 154(b) by 0 days.

(21) Appl. No.: 15/744,297

(22) PCT Filed: Sep. 6, 2015

(86) PCT No.: PCT/CN2015/088943

§ 371 (c)(1),
(2) Date: Jan. 12, 2018

(87) PCT Pub. No.: WO2017/008383

PCT Pub. Date: Jan. 19, 2017

(65) Prior Publication Data

US 2018/0213330 A1 Jul. 26, 2018

(30) Foreign Application Priority Data

Jul. 14, 2015 (CN) ..... 2015 1 0412255

(51) Int. Cl.
*H04R 7/04* (2006.01)
*H04R 7/06* (2006.01)
(Continued)

(52) U.S. Cl.
CPC ..... *H04R 9/06* (2013.01); *H04R 7/04* (2013.01); *H04R 7/18* (2013.01); *H04R 7/06* (2013.01);
(Continued)

(58) Field of Classification Search
CPC . H04R 7/04; H04R 7/18; H04R 9/025; H04R 9/06; H04R 2400/11; H04R 2499/11
(Continued)

(56) References Cited

U.S. PATENT DOCUMENTS 4,334,127 A * 6/1982 Shimada ..... H04R 9/025 335/306
7,864,977 B2 * 1/2011 Sadaie ..... H04R 1/227 381/396
(Continued)

FOREIGN PATENT DOCUMENTS

CN 102611970 A 7/2012
CN 203015100 U 6/2013
(Continued)

OTHER PUBLICATIONS

International Search Report for PCT/CN2015/088943, dated Mar. 31, 2016, ISA/CN.

*Primary Examiner* — Jesse A Elbin
(74) *Attorney, Agent, or Firm* — Yue (Robert) Xu; Apex Attorneys at Law, LLP

(57) ABSTRACT

An electronic device and a loudspeaker are provided. The loudspeaker includes: a hollow frame for being connected to the electronic device, a vibration means for producing sound through vibration, a voice coil for driving the vibration means and a magnetic circuit having a magnetic property and arranged at a lower end of an interior of the hollow frame, wherein an end face opening is provided at an upper end of the hollow frame; the vibration means covers the end face opening; one end of the voice coil is connected to the vibration means, and the other end can enter a gap of the magnetic circuit to perform reciprocating motion; the vibration means includes a vibrating diaphragm and a top dome fixedly installed in the middle of the vibrating diaphragm; an
(Continued)

outer edge of the vibrating diaphragm is connected to an edge of the end face opening.

15 Claims, 4 Drawing Sheets

(51) Int. Cl.
*H04R 7/18* (2006.01)
*H04R 7/20* (2006.01)
*H04R 9/02* (2006.01)
*H04R 9/06* (2006.01)

(52) U.S. Cl.
CPC ..... *H04R 7/20* (2013.01); *H04R 9/025* (2013.01); *H04R 2231/001* (2013.01); *H04R 2231/003* (2013.01); *H04R 2307/025* (2013.01); *H04R 2307/204* (2013.01); *H04R 2307/207* (2013.01); *H04R 2400/11* (2013.01); *H04R 2499/11* (2013.01)

(58) Field of Classification Search
USPC ..... 381/400, 423, 431
See application file for complete search history.

(56) References Cited

U.S. PATENT DOCUMENTS

| | | | | |
|---|---|---|---|---|
| 8,170,267 | B2 * | 5/2012 | Kim | H04R 9/06 381/396 |
| 2004/0086146 | A1 * | 5/2004 | Kato | H04R 9/025 381/412 |
| 2011/0200223 | A1 | 8/2011 | Hiwatashi et al. | |
| 2016/0373863 | A1 | 12/2016 | Song et al. | |
| 2017/0366888 | A1 * | 12/2017 | Xiao | H02K 41/0356 |
| 2018/0035191 | A1 * | 2/2018 | Liu | H04R 1/10 |

FOREIGN PATENT DOCUMENTS

| | | | |
|---|---|---|---|
| CN | 203301721 | U | 11/2013 |
| CN | 103856874 | A | 6/2014 |
| CN | 203645797 | U | 6/2014 |
| CN | 204291372 | U | 4/2015 |
| CN | 204291373 | U | 4/2015 |
| CN | 204291375 | U | 4/2015 |
| CN | 204498359 | U | 7/2015 |
| CN | 204598298 | U | 8/2015 |
| CN | 204795580 | U | 11/2015 |
| KR | 20070079366 | A | 8/2007 |

* cited by examiner

ELECTRONIC DEVICE AND LOUDSPEAKER THEREOF

CROSS REFERENCE OF RELATED APPLICATION

This application is a National Phase entry of PCT Application No. PCT/CN2015/088943, filed on Sep. 6, 2015, which claims the benefit of priority to Chinese patent application No. 201510412255.3 titled "ELECTRONIC DEVICE AND LOUDSPEAKER THEREOF", filed with the Chinese State Intellectual Property Office on Jul. 14, 2015, the entire disclosures of which are incorporated herein by reference.

FIELD

The present application relates to the field of audio output, and more particularly to a loudspeaker of an electronic device. In addition, the present application further relates to an electronic device including the loudspeaker.

BACKGROUND

With the wide use of electronic devices such as mobile phones and tablet computers and volume of electronic devices being getting smaller and smaller, there is a growing demand for loudspeakers to be used in the electronic devices. Since a mounting space left for the loudspeaker becomes smaller but the requirements for sound quality increase constantly, the loudspeaker is required to have characteristics such as a small size, a large sound volume, a low distortion, a large power, and the capability of operating in a case of large vibration amplitude.

In the conventional loudspeakers, generally, a top dome is assembled on a vibration diaphragm to form a vibration means. The vibration means is driven by a voice coil to move reciprocally for vibrating and further producing sound. The vibration diaphragm is generally composed of multi-layered films plus adhesive layers, and the material used for the films is generally a polyetheretherketone film material, polyarylate film material or polyurethane film material. Since multiple films are required to be composited and based on the nature of the material itself, the thickness of the vibration diaphragm is small, and then the vibration diaphragm made of multi-layered thin composite materials has a small elastic linear range in vibration, which is apt to produce unbalanced vibration, has a low reliability, and vibrates beyond a linear stretching range when vibrating at a large amplitude, resulting in a high distortion, and further adversely affecting the quality of audio output. Therefore, the conventional loudspeakers cannot be applied to the audio output that requires a high power and a large sound volume.

Accordingly, a technical issue to be addressed currently by the person skilled in the art is to provide a loudspeaker capable of producing high power and large sound volume audio output with low distortion.

SUMMARY

An aspect of the present application is to provide a loudspeaker of an electronic device capable of producing high power and large sound volume audio output with low distortion. Another aspect of the present application is to provide an electronic device including the loudspeaker described above and capable of producing high power and large sound volume audio output with low distortion.

In order to address the above technical issues, a loudspeaker of an electronic device is provided according to the present application. The loudspeaker includes a hollow frame for being connected to the electronic device; a vibration means for producing sound through vibration; a voice coil for driving the vibration means to move; and a magnetic circuit arranged at a lower end of an interior of the frame and having a magnetic property. An upper end of the frame is provided with an end face opening, the vibration means covers the end face opening, and the voice coil has one end connected to the vibration means and another end capable of entering a gap of the magnetic circuit to move reciprocally. The vibration means includes a vibration diaphragm and a top dome fixedly mounted to a middle portion of the vibration diaphragm, an outer edge of the vibration diaphragm is connected to an edge of the end face opening, and the vibration diaphragm is a silica gel elastic diaphragm.

Preferably, the vibration diaphragm is integrally provided with an upward protrusion, and the protrusion annularly surrounds an outer edge of the top dome.

Preferably, the vibration diaphragm is an annular vibration diaphragm, the top dome covers a central opening of the annular vibration diaphragm, and the outer edge of the top dome is connected to an inner edge of the annular vibration diaphragm.

Preferably, the top dome is located on an upper part of the annular vibration diaphragm, and an upper surface of the inner edge of the annular vibration diaphragm is bonded to a lower surface of the outer edge of the top dome, and one end of the voice coil is bonded to a lower surface of the annular vibration diaphragm.

Preferably, an inner edge of the annular vibration diaphragm is provided with a notch, and one end of the voice coil is bonded to a lower surface of the inner edge of the annular vibration diaphragm, and a lower surface, under the notch, of the top dome is bonded to this end of the voice coil.

Preferably, the top dome is located at a lower part of the annular vibration diaphragm, a lower surface of the inner edge of the annular vibration diaphragm is bonded to an upper surface of the outer edge of the top dome, and one end of the voice coil is bonded to a lower surface of the top dome.

Preferably, the loudspeaker further includes an annular front cover, an upper surface of the outer edge of the vibration diaphragm is bonded to a lower surface of the front cover, and the front cover is bonded to the edge of the end face opening.

Preferably, a reinforcing rib is provided in a groove of the protrusion.

An electronic device is further provided according to the present application, which includes an audio output terminal and a loudspeaker connected to the audio output terminal, and the loudspeaker is specifically the loudspeaker according to any one of the above aspects.

Preferably, the electronic device is a mobile phone, a tablet computer or a laptop computer.

The loudspeaker according to the present application includes a frame, a vibration means, a voice coil and a magnetic circuit, specifically, the vibration means includes a top dome and a vibration diaphragm, an outer edge of the vibration diaphragm is connected to an edge of an end face opening of the frame, the top dome is fixedly mounted to a middle portion of the vibration diaphragm, and the vibration diaphragm is a single-layer elastic diaphragm. As the silica gel elastic diaphragm material has a good elasticity, is easy to start vibration and may hardly over-vibrate due to a large internal damping, it has a large linear stretching range in the case of large vibration amplitude. The vibration diaphragm, since having a large elastic linear range in vibration, is advantageous for balance vibrating, may have a high reliability, and can be ensured to vibrate in the linear stretching range even in the case of high vibration amplitude, leading to a low distortion, and further improving the quality of the audio output, and thereby, the loudspeaker can be applied to audio output that requires a high power and large sound volume.

An electronic device including the loudspeaker is further provided according to the present application. Since the above loudspeaker has the above technical effects, the above electronic device should have the same technical effects and is not described in detail herein.

DETAILED DESCRIPTION

An aspect of the present application is to provide a loudspeaker of an electronic device capable of producing high power and large sound volume audio output with low distortion. Another aspect of the present application is to provide an electronic device including the loudspeaker described above and capable of producing high power and large sound volume audio output with low distortion.

In order to enable the person skilled in the art to better understand the solutions of the present application, the present application is further described in detail hereinafter with reference to the drawings and embodiments.

Figure 1:
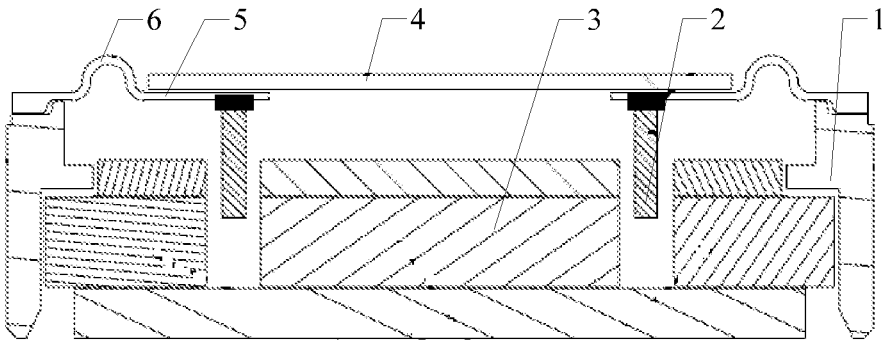
FIG. 1 is a schematic view showing the structure of a first embodiment of a loudspeaker according to the present application.

Reference is made to FIG. 1, which is a schematic view showing the structure of a first embodiment of a loudspeaker according to the present application.

The loudspeaker according to this embodiment of the present application includes a frame 1, a vibration means, a voice coil 2 and a magnetic circuit 3. The frame 1 has a hollow interior and has an upper end provided with an end face opening. The magnetic circuit 3 is arranged at a lower end of the hollow interior of the frame 1, and the vibration means covers the end face opening at an upper part of the frame 1. The voice coil 2 has one end connected to the vibration means and another end entering a gap of the magnetic circuit 3. Further, the vibration means includes a top dome 4 and a vibration diaphragm, in which an outer edge of the vibration diaphragm is connected to an edge of the end face opening of the frame 1, and the top dome 4 is fixedly mounted in the middle of the vibration diaphragm, and the vibration diaphragm is a silica gel elastic diaphragm.

In operation, the voice coil 2 is energized to produce a changing magnetic field according to an outputted audio signal. Since the magnetic circuit 3 has a magnetic property, the voice coil 2 moves reciprocally in the gap of the magnetic circuit 3, which drives the vibration means connected to the voice coil 2 to vibrate and produce sound. As the silica gel elastic diaphragm material has a good elasticity, which is easy to start vibration and hardly over-vibrate due to a large internal damping, it has a large linear stretching range in large vibration amplitude. The vibration diaphragm is advantageous for balance vibrating, and may have a high reliability since having a large elastic linear range in vibration. The vibration diaphragm can ensure to vibrate in the linear stretching range even in high vibration amplitude, which has a low distortion, and further improves the quality of the audio output. Therefore, the loudspeaker may be applied to where requires a high power and large sound volume audio output.

In order to further balance the vibration, an upward protrusion 6 may be integrally provided on the vibration diaphragm, and the protrusion 6 annularly surrounds an outer edge of the top dome 4. By providing the protrusion 6, not only can be the movement of the top dome 4 in a plane where the vibration diaphragm is located restricted, but also the elastic linear range of the vibration diaphragm in a vertical direction can be increased. The vibration diaphragm has a bent structure so that it can be stretched in a large distance. Compared with a direct stretching of a planar structure, the protrusion 6 can buffer the stretching in the vibration and improve the stability of the loudspeaker. The protrusion may also be provided downwardly. As long as the protrusion does not interfere with other components, all types of protrusion are within the scope of the present application.

In the loudspeaker according to the embodiment of the present application, the vibration diaphragm may be specifically an annular vibration diaphragm 5, and the top dome 4 covers a central opening of the annular vibration diaphragm 5, and the outer edge of the top dome 4 is connected to an inner edge of the annular vibration diaphragm 5. Covering the central opening of the annular vibration diaphragm 5 by the top dome 4 ensures the integrity of the vibration means, so that the vibration means can work normally. Moreover, adopting the annular structure may reduce the mass of the vibration means and further enhance the audio output effect of the loudspeaker. The vibration diaphragm may also be one piece, which is also within the scope of the present application.

In the case that the annular vibration diaphragm 5 is used, the top dome 4 is required to completely cover the central opening, so the top dome 4 can be connected to the annular vibration diaphragm 5 in multiple connection ways. The top dome 4 may be located on an upper part of the annular vibration diaphragm 5, in this case, an upper surface of the inner edge of the annular vibration diaphragm 5 is bonded to a lower surface of the outer edge of the top dome 4, and an end of the voice coil 2 is bonded to a lower surface of the annular vibration diaphragm 5. By bonding in this way, the connection is more stable, and the normal operation of the loudspeaker is ensured. Other connection ways may also be adopted, all of which are within the scope of the present application.

Figure 2:
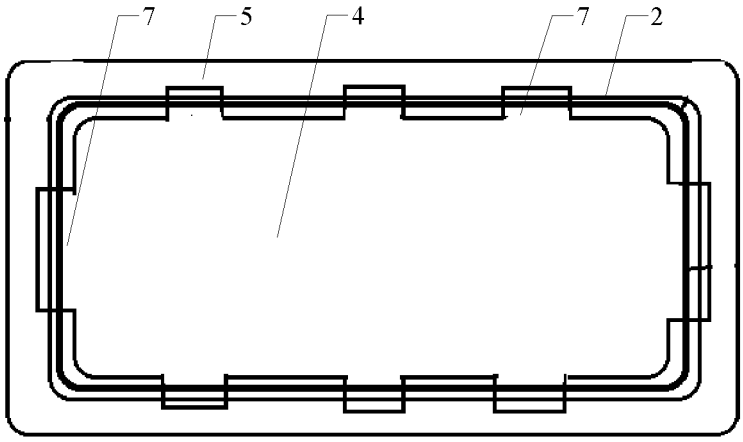
FIG. 2 is a schematic view showing the structure of a second embodiment of the loudspeaker according to the present application.
Figure 3:
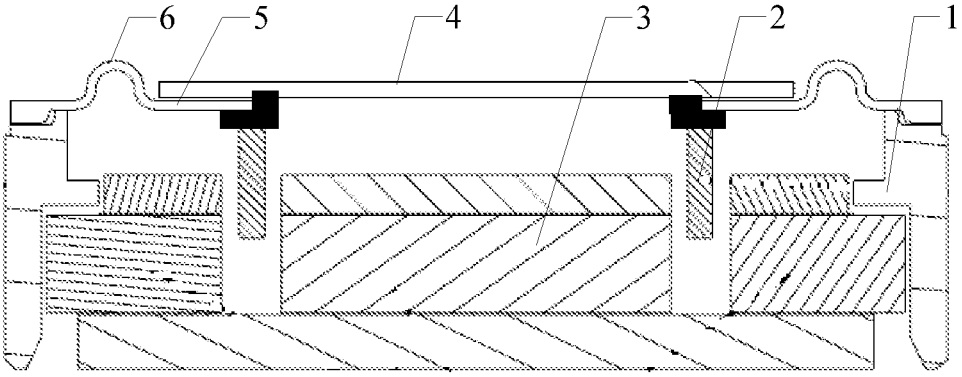
FIG. 3 is a schematic view showing the structure of a third embodiment of the loudspeaker according to the present application.
Figure 4:
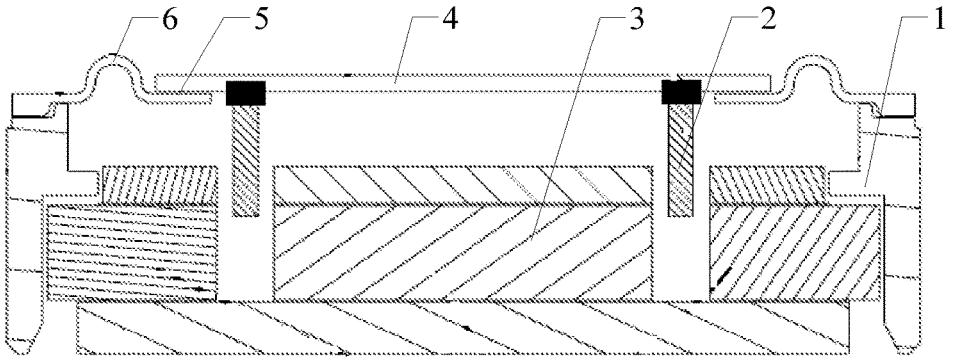
FIG. 4 is a schematic view showing the structure of a fourth embodiment of the loudspeaker according to the present application.

In the case that the top dome 4 is located on the upper part of the annular vibration diaphragm 5, the top dome 4 can be connected to the annular vibration diaphragm 5 in multiple connection ways. Reference is made to FIGS. 2 to 4. FIG. 2 is a schematic view showing the structure of a second embodiment of the loudspeaker according to the present application; FIG. 3 is a schematic view showing the structure of a third embodiment of the loudspeaker according to the present application; and FIG. 4 is a schematic view showing the structure of a fourth embodiment of the loudspeaker according to the present application.

As shown in FIG. 2, the inner edge of the annular vibration diaphragm 5 is provided with a notch 7, one end of the voice coil 2 is bonded to the lower surface of the inner edge of the annular vibration diaphragm 5, and the lower surface, under the notch 7, of the top dome 4 is also bonded to this end of the voice coil 2, and the glue can be applied on an inner side or outer side of the voice coil 2 or can be applied on the both sides. With this connection way, the installation process is simple, which can improve the installation efficiency. The notch 7 may also not be provided. All the solutions are within the scope of the present application as long as via which the stable connection between the components can be ensured.

It may also be as shown in FIG. 3 that, the top dome 4 is arranged on the upper part of the annular vibration diaphragm 5, and the voice coil 2 is further bonded to a junction of the top dome 4 and the annular vibration diaphragm 5 such that the voice coil 2 is bonded to both of the two parts, which also facilitates the mounting. Alternatively, it may be as shown in FIG. 4 that, the top dome 4 is arranged on the upper part of the annular vibration diaphragm 5, and the voice coil 2 is further bonded to the lower surface of the top dome 4. All the solutions are within the scope of the present application as long as they can ensure stable connection between the components.

Figure 5:
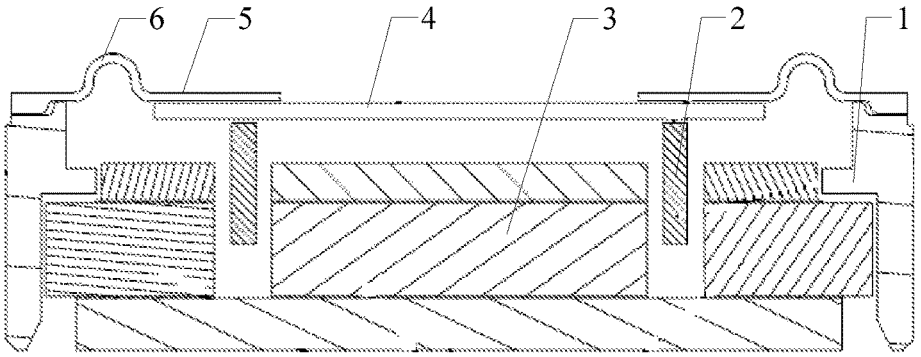
FIG. 5 is a schematic view showing the structure of a fifth embodiment of the loudspeaker according to the present application.
Figure 6:
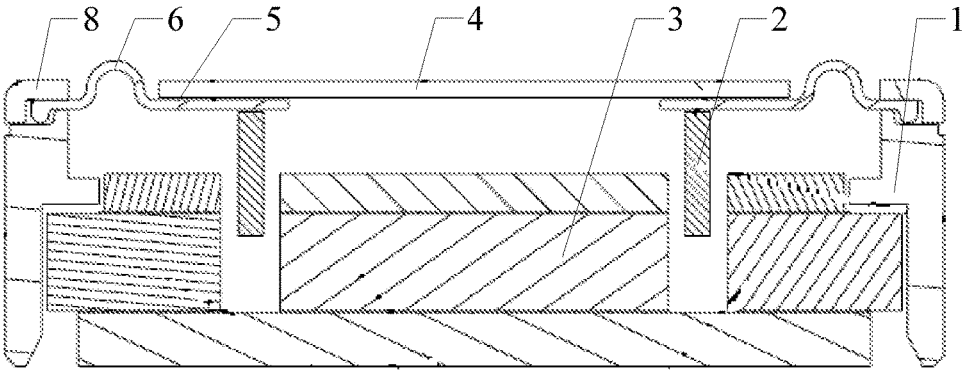
FIG. 6 is a schematic view showing the structure of a sixth embodiment of the loudspeaker according to the present application.

In the loudspeaker according to an embodiment of the present application, the top dome 4 may also be arranged on a lower part of the annular vibration diaphragm 5. Reference is made to FIG. 5, which is a schematic view showing the structure of a fifth embodiment of the loudspeaker according to the present application.

A lower surface of the inner edge of the annular vibration diaphragm 5 is bonded to an upper surface of the outer edge of the top dome 4, one end of the voice coil 2 is bonded to the lower surface of the top dome, and the corresponding functions of the loudspeaker may also be achieved through this way. Therefore, different top and bottom positional relationships between the top dome 4 and the annular vibration diaphragm 5 and different mounting positions of the voice coil 2 are all within the scope of the present application.

Figure 7:
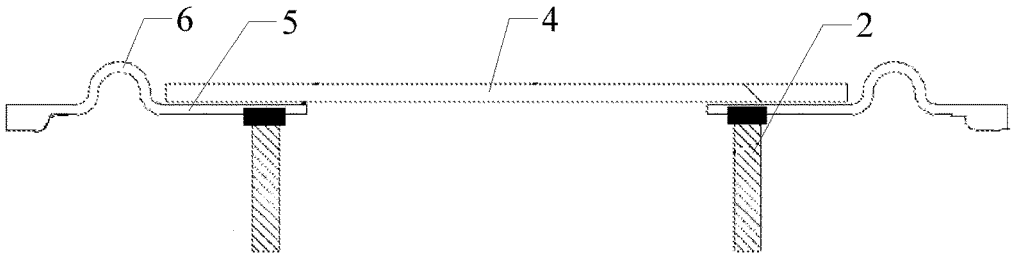
FIG. 7 is a schematic view showing the structure of a seventh embodiment of the loudspeaker according to the present application.
Figure 8:
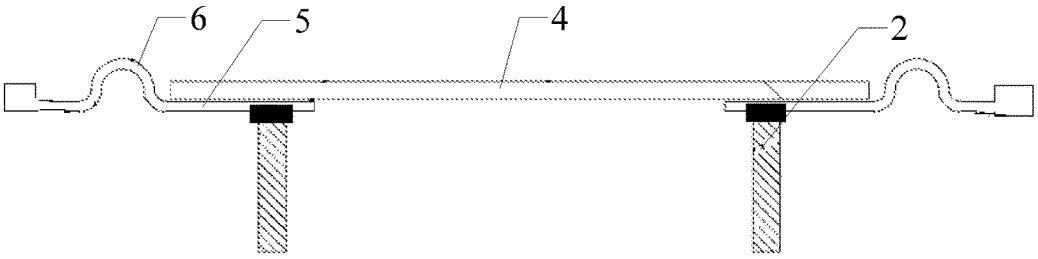
FIG. 8 is a schematic view showing the structure of an eighth embodiment of the loudspeaker according to the present application.
Figure 9:
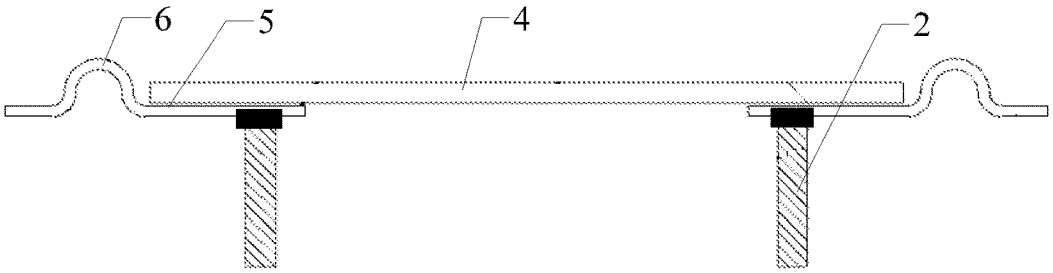
FIG. 9 is a schematic view showing the structure of a ninth embodiment of the loudspeaker according to the present application.
Figure 10:
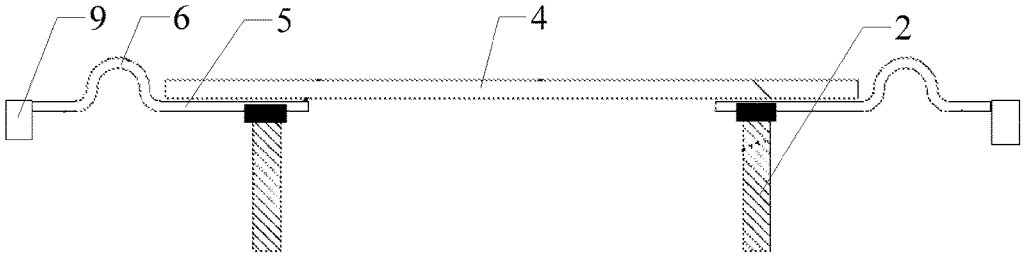
FIG. 10 is a schematic view showing the structure of a tenth embodiment of the loudspeaker according to the present application.

In order to stably connect the outer edge of the vibration diaphragm to the frame 1, a variety of connection ways for connecting therebetween can be adopted. Please refer to FIGS. 6 to 10, FIG. 6 is a schematic view showing the structure of a sixth embodiment of the loudspeaker according to the present application; FIG. 7 is a schematic view showing the structure of a seventh embodiment of the loudspeaker according to the present application; FIG. 8 is a schematic view showing the structure of an eighth embodiment of the loudspeaker according to the present application; FIG. 9 is a schematic view showing the structure of a ninth embodiment of the loudspeaker according to the present application; and FIG. 10 is a schematic view showing the structure of a tenth embodiment of the loudspeaker according to the present application.

The loudspeaker according to an embodiment of the present application may further include an annular front cover 8, an upper surface of the outer edge of the vibration diaphragm is bonded to a lower surface of the front cover 8, and then the front cover 8 is bonded to the edge of the end face opening of the frame 1. By providing the front cover 8, the connection between the vibration diaphragm and the frame 1 can be more stable. The front cover 8 may not be provided, which is also within the scope of the present application.

The vibration diaphragm can be connected to the frame 1 in multiple connection ways. As shown in FIG. 7, the outer edge of the vibration diaphragm is provided with a downward convex edge, so as to better match the edge of the end face opening of the frame. It may also be as shown in FIG. 8 that the outer edge of the vibration diaphragm is provided with an upward convex edge, or it may be as shown in FIG. 9 that no convex edge is provided at the outer edge of the vibration diaphragm, and the outer edge of the vibration diaphragm is a plane structure, or it may be as shown in FIG. 10 that a convex ring 9 is formed on the outer edge of the vibration diaphragm by injection molding. The convex ring 9 may be made of a plastic material, and may also be made of a metallic material. The above connection ways or other connection ways are all within the scope of the present application as long as they can ensure a stable connection of the vibration diaphragm to the frame 1.

Figure 11:
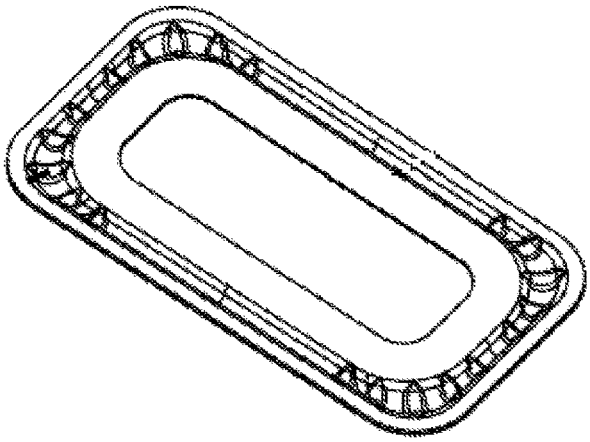
FIG. 11 is a schematic view showing the structure of an embodiment of a vibration diaphragm in the loudspeaker according to the present application.
Figure 12:
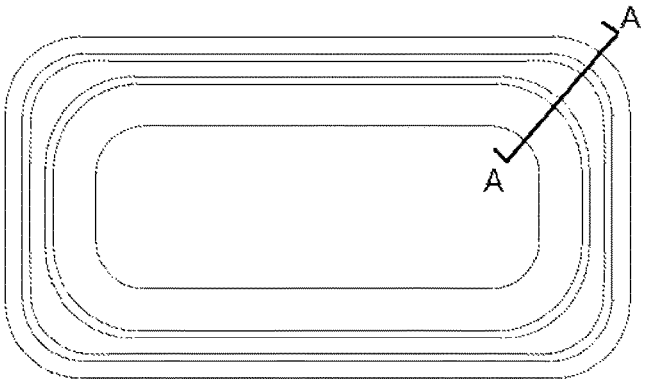
FIG. 12 is a schematic view showing the structure of another embodiment of the vibration diaphragm in the loudspeaker according to the present application.
Figure 13:
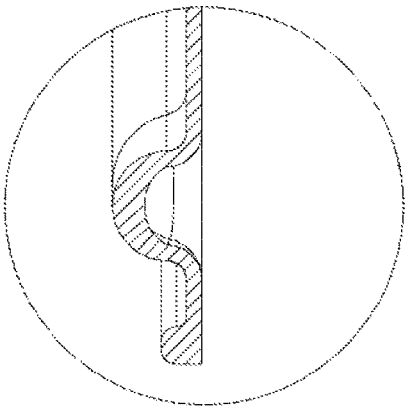
FIG. 13 is an enlarged sectional view of another embodiment of the vibration diaphragm in the loudspeaker according to the present application.

In order to restrict the movement of the vibration diaphragm in its plane and improve the vibration stability of the vibration diaphragm, a variety of ways can be adopted. Reference is made to FIGS. 11 to 13. FIG. 11 is a schematic view showing the structure of an embodiment of a vibration diaphragm in the loudspeaker according to the present application; FIG. 12 is a schematic view showing the structure of another embodiment of the vibration diaphragm in the loudspeaker according to the present application; and FIG. 13 is an enlarged sectional view of another embodiment of the vibration diaphragm in the loudspeaker according to the present application.

In the loudspeaker according to an embodiment of the present application, in order to further increase the strength of the vibration diaphragm, reinforcing ribs may be provided in a groove on a back side of the protrusion 6, and the reinforcing ribs may be arranged at a corner or on opposite sides or in the groove evenly, as long as they can ensure the strength of the vibration diaphragm. The reinforcing ribs can have various shapes, such as a cylindrical shape, a circular arc shape and a prismatic shape, all of which are within the scope of the present application. Other reinforcing ways may also be adopted, for example, making a portion, at the corner, of the protrusion 6 have a greater width, and the vibration diaphragm also has a greater width at the corner, and may be narrow at the rest positions. It is also possible to make the protrusion 6 have a large thickness at the highest point and gradually become thin towards two sides of the highest point. By the locally thickening design, the strength and stability of the vibration diaphragm is ensured, and all of the ways are within the scope of the present application.

In describing the loudspeaker according to the above embodiments, the positional relationships between the upper and lower positions referred are all positional relationships formed in the case that the vibration diaphragm is horizontally placed and the magnetic circuit 3 is located below the vibration diaphragm, and the upper surface and the lower surface are both specific surfaces, and when the placing manner of the loudspeaker is changed, the specific surfaces do not change.

In addition to the above loudspeaker, an electronic device including the above loudspeaker is further provided according to an embodiment of the present application. For the structure of other parts of the electronic device, reference may be made to the conventional technology, and details are not described herein again.

Specifically, the above electronic device may be a cell phone, a tablet computer or a laptop computer. It may also be other electronic devices that need to output audio, such as a radio, which are all within the scope of the present application.

The electronic device and the loudspeaker thereof according to the present application are described in detail hereinbefore. The principle and the embodiments of the present application are illustrated herein by specific examples. The above description of examples is only intended to help the understanding of the method and core concept of the present application. It should be noted that, for the person skilled in the art, a few of modifications and improvements may be made to the present application without departing from the principle of the present application, and these modifications and improvements are also deemed to fall into the scope of protection of the present application defined by the claims.

The invention claimed is:

1. A loudspeaker of an electronic device, comprising:

a hollow frame for being connected to the electronic device;

a vibration means comprising an annular vibration diaphragm and a top dome fixedly mounted to a middle portion of the vibration diaphragm, wherein an outer edge of the vibration diaphragm is connected to an edge of the end face opening, and the vibration diaphragm is a silica gel elastic diaphragm;

a voice coil for driving the vibration means to move; and a magnetic circuit arranged at a lower end of an interior of the hollow frame and having a magnetic property, wherein an upper end of the hollow frame is provided with an end face opening, the vibration means covers the end face opening, and the voice coil has one end connected to the vibration means and another end entering a gap of the magnetic circuit to move reciprocally, wherein an inner edge of the annular vibration diaphragm is provided with a notch, and one end of the voice coil is bonded to a lower surface of the inner edge of the annular vibration diaphragm, and a lower surface, under the notch, of the top dome is bonded to this end of the voice coil.

2. An electronic device, comprising:

an audio output terminal, and a loudspeaker connected to the audio output terminal, wherein the loudspeaker is the loudspeaker according to claim 1.

3. The electronic device according to claim 2, wherein the electronic device is a mobile phone, a tablet computer or a laptop computer.

4. The loudspeaker according to claim 1, wherein the vibration diaphragm is integrally provided with an upward protrusion, and the protrusion annularly surrounds an outer edge of the top dome.

5. An electronic device, comprising:

an audio output terminal, and a loudspeaker connected to the audio output terminal, wherein the loudspeaker is the loudspeaker according to claim 4.

6. The loudspeaker according to claim 4, wherein a reinforcing rib is provided in a groove of the protrusion.

7. An electronic device, comprising:

an audio output terminal, and a loudspeaker connected to the audio output terminal, wherein the loudspeaker is the loudspeaker according to claim 6.

8. The loudspeaker according to claim 1, wherein the top dome covers a central opening of the annular vibration diaphragm, and the outer edge of the top dome is connected to an inner edge of the annular vibration diaphragm.

9. An electronic device, comprising:

an audio output terminal, and a loudspeaker connected to the audio output terminal, wherein the loudspeaker is the loudspeaker according to claim 8.

10. The loudspeaker according to claim 8, wherein the top dome is located on an upper part of the annular vibration diaphragm, and an upper surface of the inner edge of the annular vibration diaphragm is bonded to a lower surface of the outer edge of the top dome, and one end of the voice coil is bonded to a lower surface of the annular vibration diaphragm.

11. An electronic device, comprising:

an audio output terminal, and a loudspeaker connected to the audio output terminal, wherein the loudspeaker is the loudspeaker according to claim 10.

12. The loudspeaker according to claim 8, wherein the top dome is located at a lower part of the annular vibration diaphragm, a lower surface of the inner edge of the annular vibration diaphragm is bonded to an upper surface of the outer edge of the top dome, and one end of the voice coil is bonded to a lower surface of the top dome.

13. An electronic device, comprising:

an audio output terminal, and a loudspeaker connected to the audio output terminal, wherein the loudspeaker is the loudspeaker according to claim 12.

14. The loudspeaker according to claim 1, further comprising: an annular front cover, wherein an upper surface of the outer edge of the vibration diaphragm is bonded to a lower surface of the front cover, and the front cover is bonded to the edge of the end face opening.

15. An electronic device, comprising:

an audio output terminal, and a loudspeaker connected to the audio output terminal, wherein the loudspeaker is the loudspeaker according to claim 14.

* * * * *